US006112351A

United States Patent [19]

Hawkins et al.

[11] Patent Number: 6,112,351

[45] Date of Patent: Sep. 5, 2000

[54] CLAM SHELL TOOL ASSEMBLY APPARATUS

[75] Inventors: Eric H. Hawkins, Lake Elmo; Pierre A. G. Oster, White Bear Lake, both of Minn.

[73] Assignee: Bicycle Tools Incorporated, St. Paul, Minn.

[21] Appl. No.: 09/329,680

[22] Filed: Jun. 10, 1999

[51] Int. Cl.[7] ..... B25B 13/00

[52] U.S. Cl. ..... 7/138; 7/118; 81/440; 81/437

[58] Field of Search ..... 7/138, 128, 129, 7/118; 81/427.5, 177.4, 437, 438, 440, 439; 206/373, 581

[56] References Cited

U.S. PATENT DOCUMENTS

| | | | |
|---|---|---|---|
| 635,562 | 10/1899 | Marschutz . | |
| 1,369,829 | 3/1921 | Minges . | |
| 1,398,583 | 11/1921 | Bovee . | |
| 2,804,970 | 9/1957 | Kuc . | |
| 2,828,855 | 4/1958 | Mosch . | |
| 4,854,045 | 8/1989 | Schaub . | |
| 4,908,947 | 3/1990 | Schaub . | |
| 5,146,815 | 9/1992 | Scott . | |
| 5,303,439 | 4/1994 | Seals . | |
| 5,313,860 | 5/1994 | Liou . | |
| 5,320,004 | 6/1994 | Hsiao . | |
| 5,450,774 | 9/1995 | Chang . | |
| 5,499,562 | 3/1996 | Feng | 81/177.4 |
| 5,581,834 | 12/1996 | Collins . | |
| 5,632,056 | 5/1997 | Hsiao . | |
| 5,655,242 | 8/1997 | Chuang . | |
| 5,669,492 | 9/1997 | Chao | 206/234 |
| 5,711,042 | 1/1998 | Chuang . | |
| 5,711,194 | 1/1998 | Anderson . | |
| 6,006,385 | 12/1999 | Kershaw et al. | 7/129 |
| 6,009,582 | 1/2000 | Harrison et al. | 7/118 |

*Primary Examiner*—Stephen F. Gerrity
*Assistant Examiner*—Hadi Shakeri
*Attorney, Agent, or Firm*—Rider Bennett Egan & Arundel

[57] ABSTRACT

A clam shell tool assembly apparatus containing a number of tools for bicycle repair, comprising: a walled base having two side walls, a front wall, and a rear wall, the side walls, front wall, and rear wall cooperating to form a first tray adapted to hold a first tool set; a walled top having two side walls and a front wall, the side walls and front wall cooperating to form a second tray adapted to hold a second tool set; a first mounting means adapted to pivotally mount the first tool set on the walled base; a second mounting means adapted to pivotally mount the second tool set on the walled top; and the walled base further having a groove mating with a projection on the walled top, whereby the walled base and walled top slide together to form a clam shell enclosure surrounding the first tool set and second tool set.

19 Claims, 4 Drawing Sheets

CLAM SHELL TOOL ASSEMBLY APPARATUS

BACKGROUND OF THE INVENTION

This invention relates to hand tools and more particularly to a multipurpose bicycle repair and maintenance tool kit with a clamshell enclosure that prevents the tools from damaging a backpack or other tool carrier. The present invention is a compact bicycle tool kit that is easily carried on the bicycle or by the rider for use if a breakdown occurs or an adjustment needs to be made on the road.

Bicyclists have long been plagued with the problem of minor breakdowns occurring while riding when they are far from help or access to repair equipment. Because of the excess weight and limited storage space, conventional tools are seldom transported along with the bike for repair and adjustment purposes. The majority of problems occurring on conventional bicycles can be fixed or adjusted with only a few specific tools. Combining these specific tools into one lightweight compact unit would be particularly useful to the rider.

U.S. Pat. No. 5,711,042 (Chang) shows a tool combination for a bicycle. However, the tools in this patent are unprotected by any sort of enclosure. Therefore, if the tool set is carried in a backpack or in a soft bicycle tool carrier, the sharp tools may cause damage. Also, if the rider reaches into the backpack or carrier, and one of the tools has opened, he may cut his fingers. Also, the two halves of the tool set are held together by a complex locking mechanism, increasing the cost of manufacture.

There is a need for a bicycle tool set with a clamshell enclosure that protects the backpack and the fingers of the bicyclist from damage caused by the tools. The clamshell tool assembly should have two parts which slide together to form the clamshell enclosure without the need for a complicated locking mechanism.

SUMMARY OF THE INVENTION

A clam shell tool assembly apparatus containing a number of tools for bicycle repair, comprising:

a) a walled base having two side walls, a front wall, and a rear wall, the side walls, front wall, and rear wall cooperating to form a first tray adapted to hold a first tool set;

b) a walled top having two side walls and a front wall, the side walls and front wall cooperating to form a second tray adapted to hold a second tool set;

c) a first mounting means adapted to pivotally mount the first tool set on the walled base;

d) a second mounting means adapted to pivotally mount the second tool set on the walled top;

and the walled base further having a groove mating with a projection on the walled top, whereby the walled base and walled top slide together to form a clam shell enclosure surrounding the first tool set and second tool set.

A principal object and advantage of the present invention is that the walled base and walled top slide together to form a clamshell enclosure which surrounds the two tool sets and prevents the tools from damaging either a backpack or the fingers of the bicyclist.

Another principal object and advantage of the present invention is that there is no need for a complicated locking mechanism to hold the walled base and walled top together.

DETAILED DESCRIPTION OF THE PREFERRED EMBODIMENTS

Figure 1:
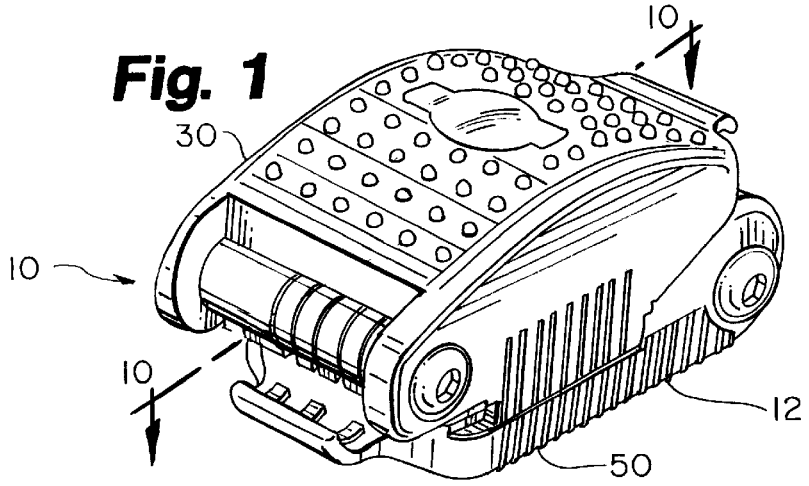
FIG. 1 is a perspective view of the clam shell tool assembly of the present invention.
Figure 2:
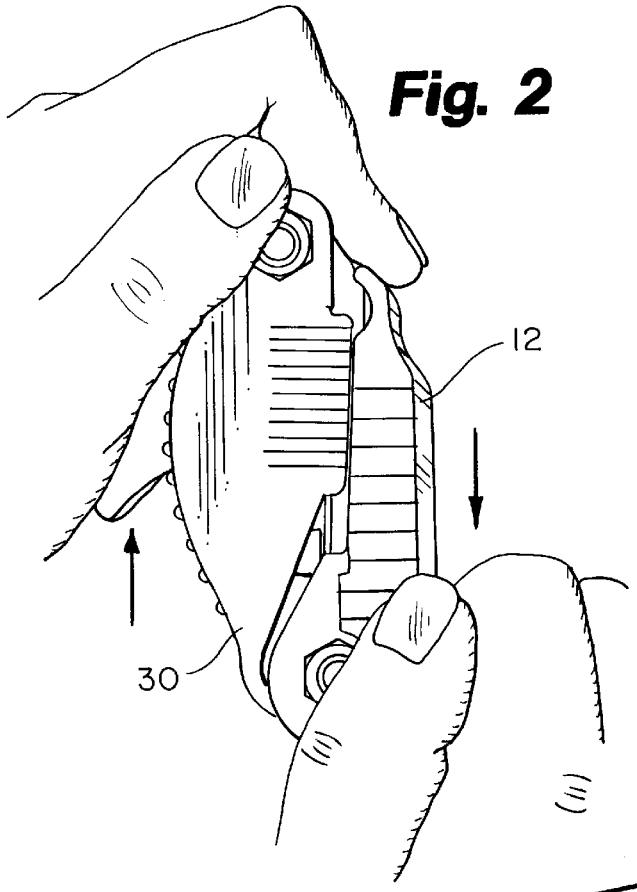
FIG. 2 is a side elevational view of the clam shell tool assembly of the present invention, with the walled base and walled top forming a clam shell enclosure, showing how the walled base and walled top slide apart.
Figure 3:
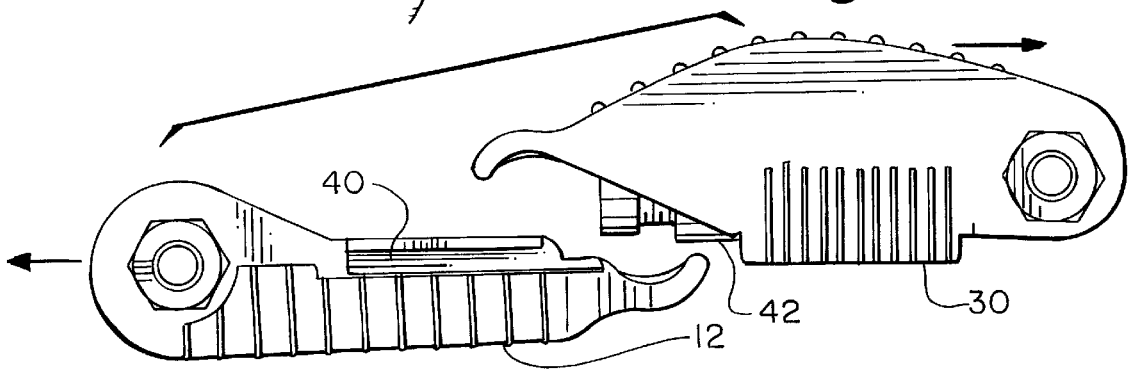
FIG. 3 is a side elevational view of the clam shell tool assembly of the present invention, with the walled base and walled top slid apart from each other.
Figure 4:
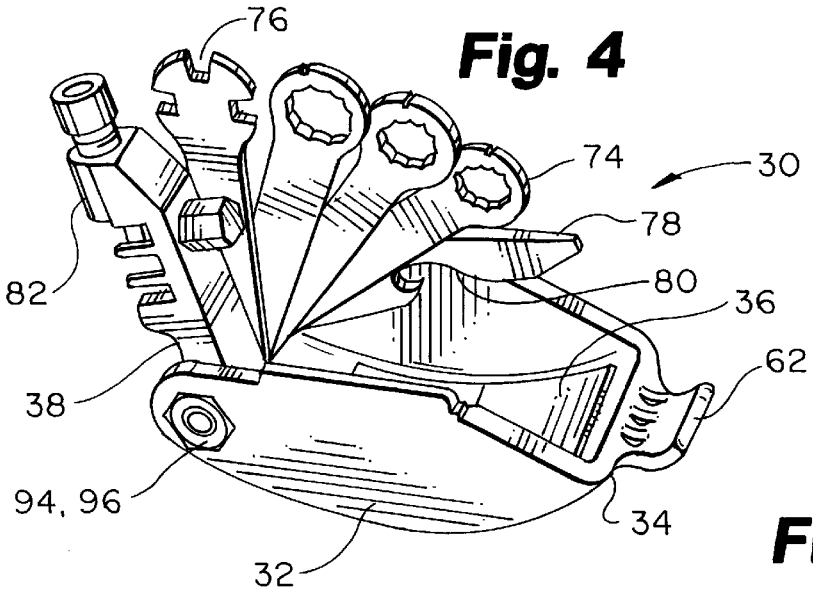
FIG. 4 is a perspective view of the clam shell tool assembly of the present invention, showing the walled top with the second tool set.
Figure 5:
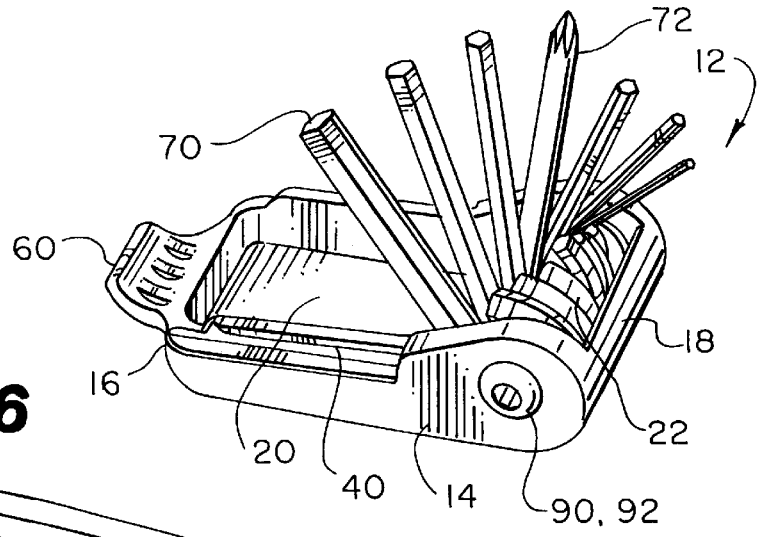
FIG. 5 is a perspective view of the clam shell tool assembly of the present invention, showing the walled base with the first tool set.

The clam shell tool assembly apparatus of the present invention is generally shown in the Figures as reference numeral 10.

The clam shell tool assembly 10 further comprises a walled base 12 having, preferably, side walls 14, a front wall 16, and a rear wall 18. The side walls 14, front wall 16, and rear wall 18 cooperate to form a first tray 20 adapted to hold a first tool set 22.

A walled top 30 has, preferably, side walls 32 and a front wall 34. The side walls 32 and front wall 34 cooperate to form a second tray 36 adapted to hold a second tool set 38.

The walled base 12 has a groove 40 which mates with a projection 42 on the walled top 30. The projection 42 slides into the groove 40, allowing the walled base 12 and walled top 30 to slide together to form a clam shell enclosure 50 surrounding the first tool set 22 and second tool set 38. Of course, the groove could alternatively be on the walled top with the projection being on the walled base.

Figure 6:
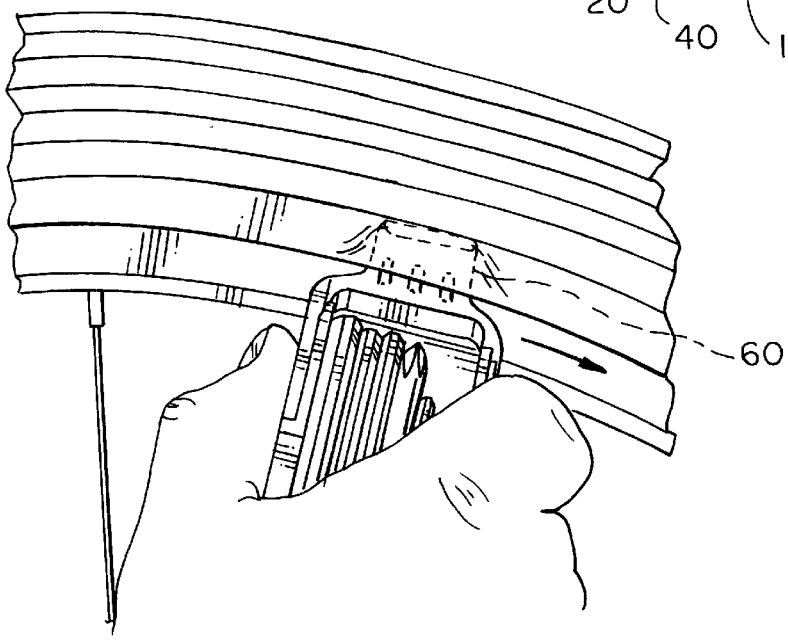
FIG. 6 is a fragmentary view of a bicycle wheel rim and tire, showing the use of the tire lever to remove a tire from the wheel rim.
Figure 7:
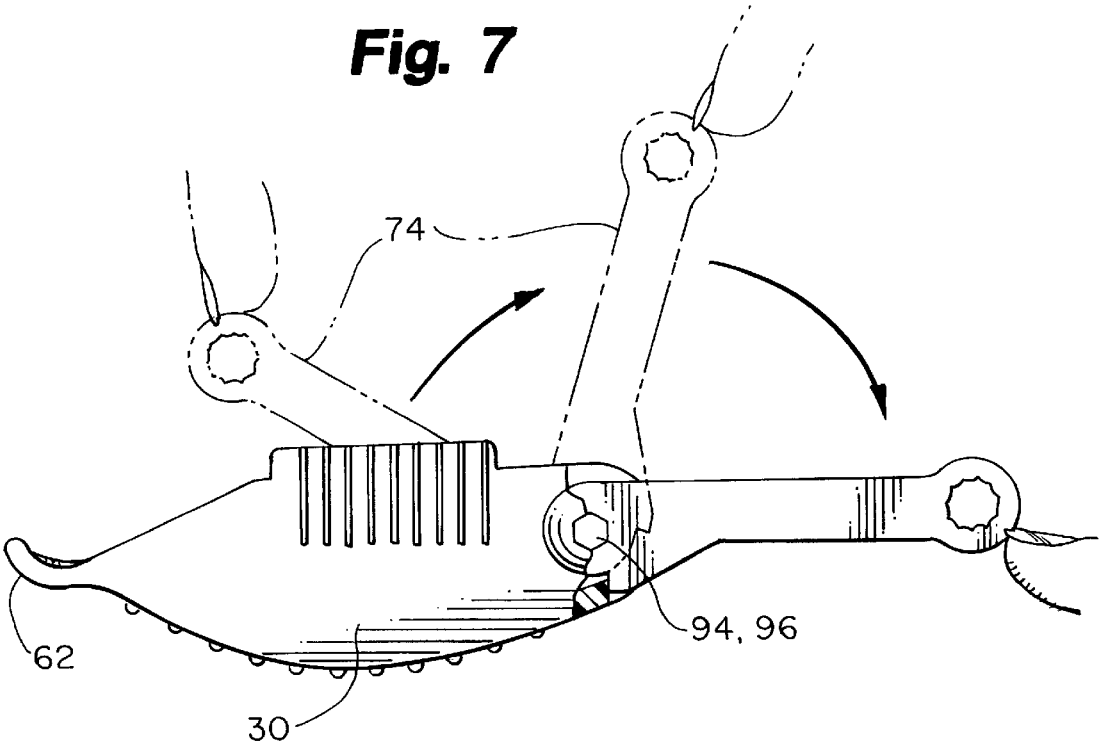
FIG. 7 is a side elevational view of the clam shell tool assembly of the present invention, showing the use of a finger nail to pivot one of the box-end wrenches out of the walled top.
Figure 8:
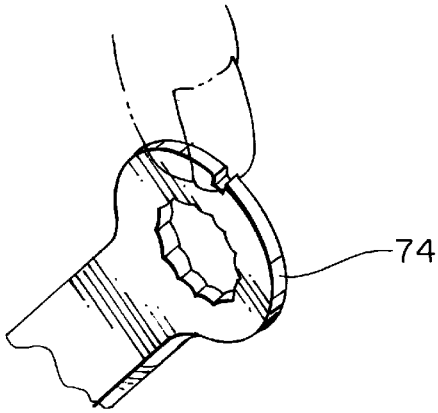
FIG. 8 is a detailed view of a portion of FIG. 7.
Figure 9:
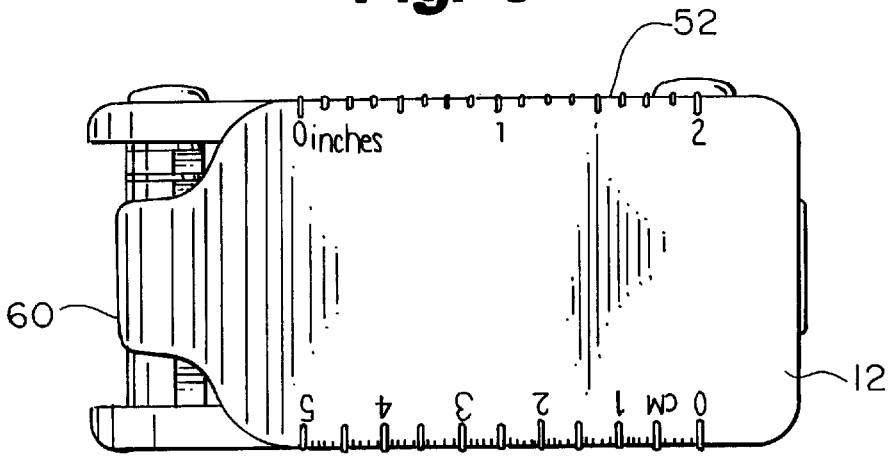
FIG. 9 is plan view of the clam shell tool assembly of the present invention, showing the outside of the walled base.
Figure 10:
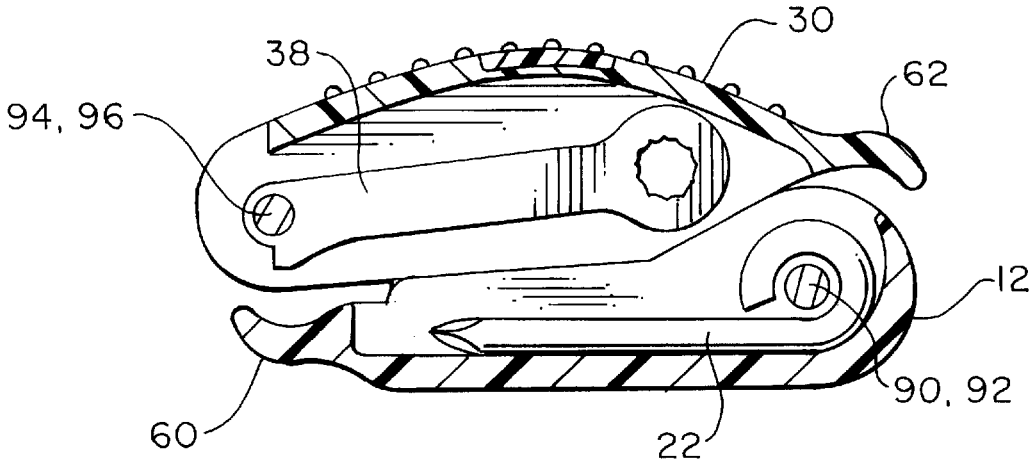
FIG. 10 is a cross-sectional view of the clam shell tool assembly of the present invention along the lines 10 of FIG. 1.

The clam shell tool assembly 10 may preferably further comprise a tire lever 60 on the walled base 12. The clam shell tool assembly 10 may also further comprise a second tire lever 62 on the walled top 30. As shown in FIG. 6, the tire lever 60 or 62 may be used to assist in removing or installing a tire on the wheel rim.

The first tool set 22 may preferably further comprise at least one hex wrench 70. In the preferred embodiment, the first tool set 22 has six hex wrenches 70.

The first tool set 22 may preferably further comprise a Phillips screwdriver 72.

The second tool set 38 may preferably further comprise at least one box-end wrench 74. In the preferred embodiment, the second tool set 38 comprises three box-end wrenches 74.

The second tool set 38 may preferably further comprise at least one spoke wrench 76. In the preferred embodiment, the second tool set 38 comprises three spoke wrenches 76.

The second tool set 38 may preferably further comprise a flat-head screwdriver 78.

The second tool set 3 8 may preferably further comprise a bottle opener 80.

The second tool set 38 may preferably further comprise a bicycle chain tool 82.

The clam shell tool assembly 10 may further comprise a patch kit (not shown) within the clam shell enclosure 50.

A ruler 52 may be engraved on the walled base 12.

The clam shell tool assembly 10 preferably further comprises a first mounting means 90 adapted to pivotally mount the first tool set 22 on the walled base 12. In the preferred embodiment, the first mounting means 90 further comprises a first bolt 92 engaging the side walls 14 of the walled base 12.

The clam shell tool assembly 10 preferably further comprises a second mounting means 94 adapted to pivotally mount the second tool set 38 on the walled top 30. In the preferred embodiment, the second mounting means 94 further comprises a second bolt 96 engaging the side walls 32 of the walled top 30.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A clam shell tool assembly apparatus containing a number of tools for bicycle repair, comprising a clam shell enclosure further comprising:

(a) a walled base, the walls of said base cooperating to form a first tray adapted to hold a first tool set;

(b) a walled top, the walls of said top cooperating to form a second tray adapted to hold a second tool set; and clam shell enclosure further comprising a groove on one of the walled base and walled top mating with a projection on the other of walled base and walled top, whereby the walled base and walled top slide together thereby securing the walled base to the walled top in opposing relation and together enclosing the tool sets.

2. The clam shell tool assembly of claim 1, further comprising a tire lever on the walled base.

3. The clam shell tool assembly of claim 2, further comprising a second tire lever on the walled top.

4. The clam shell tool assembly of claim 1, wherein the first tool set further comprises at least one hex wrench.

5. The clam shell tool assembly of claim 4, wherein the first tool set further comprises a Phillips screwdriver.

6. The clam shell tool assembly of claim 1, wherein the second tool set further comprises at least one box-end wrench.

7. The clam shell tool assembly of claim 1, wherein the second tool set further comprises at least one spoke wrench.

8. The clam shell tool assembly of claim 1, wherein the second tool set further comprises a flat-head screwdriver.

9. The clam shell tool assembly of claim 1, wherein the second tool set further comprises a bottle opener.

10. The clam shell tool assembly of claim 1, wherein the second tool set further comprises a bicycle chain tool.

11. The clam shell tool assembly of claim 1, further comprising a ruler engraved on the walled base.

12. The clam shell tool assembly of claim 1, further comprising a first mounting means adapted to pivotally mount the first tool set on the walled base.

13. The clam shell tool assembly of claim 12, wherein the first mounting means further comprises a first bolt engaging the walls of the walled base.

14. The clam shell tool assembly of claim 1, further comprising a second mounting means adapted to pivotally mount the second tool set on the walled top.

15. The clam shell tool assembly of claim 14, wherein the second mounting means further comprises a second bolt engaging the walls of the walled top.

16. A clam shell tool assembly apparatus containing a number of tools for bicycle repair, comprising a clam shell enclosure further comprising:

a) a walled base, the walls of said base cooperating to form a first tray adapted to hold a first tool set;

b) a walled top, the walls of said top cooperating to form a second tray adapted to hold a second tool set;

c) a first mounting means adapted to pivotally mount the first tool set;

d) a second mounting means adapted to pivotally mount the second tool set; and clam shell enclosure further comprising a groove on one of the walled base and walled top mating with a projection on the other of walled base and walled to, whereby the walled base and walled top slide together, thereby securing the walled base to the walled top without a locking mechanism in opposing relation and together enclosing the tool sets.

17. A clam shell tool assembly apparatus containing a number of tools for bicycle repair, comprising a clam shell enclosure further comprising:

(a) a walled base having two side walls, a front wall, and a rear wall, the side walls, front wall, and rear wall cooperating to form a first tray adapted to hold a first tool set, the first tool set further comprising at least one hex wrench and a Philips screwdriver;

(b) a walled top having two side walls and a front wall, the side walls and front wall cooperating to form a second tray adapted to hold a second tool set, the second tool set further comprising at least one box-end wrench, at least one spoke wrench, and a flat-head screwdriver;

(c) a first mounting means adapted to pivotally mount the first tool set on the walled base;

(d) a second mounting means adapted to pivotally mount the second tool set on the walled top;

and the walled base further having a groove mating with a projection on the walled top, whereby the walled base and walled top slide together in opposing relation to form a clam shell enclosure and together surrounding the first tool set and second tool set.

18. The clam shell tool assembly of claim 17, further comprising a bottle opener.

19. The clam shell tool assembly of claim 17, further comprising a bicycle chain tool.

* * * * *